US005678613A

United States Patent [19]

Murayama et al.

[11] Patent Number: 5,678,613

[45] Date of Patent: Oct. 21, 1997

[54] REINFORCEMENT BINDING MACHINE

[75] Inventors: Keijiro Murayama; Ichiro Kusakari; Atsushi Miyazaki; Syuichi Ishii, all of Tokyo, Japan

[73] Assignee: Max Co., Ltd., Tokyo, Japan

[21] Appl. No.: 672,545

[22] Filed: Jun. 28, 1996

[30] Foreign Application Priority Data

| | | | |
|---|---|---|---|
| Jun. 30, 1995 | [JP] | Japan | 7-188121 |
| Dec. 14, 1995 | [JP] | Japan | 7-347250 |
| Dec. 14, 1995 | [JP] | Japan | 7-347252 |

[51] Int. Cl.[6] ..... B21F 15/04

[52] U.S. Cl. ..... 140/119; 140/57; 72/15.1

[58] Field of Search ..... 140/57, 93 A, 140/93.2, 93.6, 119; 72/15.1

[56] References Cited

U.S. PATENT DOCUMENTS 5,515,887 5/1996 Hanagasaki et al. ..... 140/119

FOREIGN PATENT DOCUMENTS 0 295 224 12/1988 European Pat. Off. .
44 13 627 10/1994 Germany .

*Primary Examiner*—Lowell A. Larson
*Attorney, Agent, or Firm*—Cushman Darby & Cushman, IP Group of Pillsbury Madison & Sutro, LLP

[57] ABSTRACT

A reinforcement binding machine for binding reinforcement with a wire, comprises: a wire feed device for feeding out the wire; a guide arm for guiding the fed-out wire such that the wire is wound in a loop shape around the intersecting portions of the reinforcements; a wire twisting device for gripping part of the looped portion of the wire wound around the reinforcements to twist and tighten the same; a wire cutting device for cutting off the looped portion of the wire from the base portion of the wire; and a newly-wire setting mechanism for positioning the leading end of the wire to a given position when newly loading the wire into the reinforcement binding machine.

8 Claims, 16 Drawing Sheets

REINFORCEMENT BINDING MACHINE

BACKGROUND OF THE INVENTION

The present invention relates to a reinforcement binding machine. More specifically, the invention relates to a mechanism for setting a new wire when the new wire is loaded in the reinforcement binding machine. Generally, when placing a reinforced concrete in a building or a structure, a concrete is placed after reinforcements arranged so as to intersect each other vertically and horizontally are bound together by a wire. Recently, the binding of the reinforcements has been carried out by a reinforcement binding machine.

There is known a reinforcement binding machine which, as disclosed in Japanese Utility Model Application Laid-open No. Hei. 5-3494 filed by the present applicants, winds a binding wire in a loop shape around the reinforcements and, after then, grips and rotates part of the looped portion of the wound wire by use of a hook to thereby twist and rotate the wire, so that the reinforcements can be bound together by the wire.

In the reinforcement binding machine, as shown in FIG. 18, a main switch 40 is previously turned on and, in binding the reinforcements, if a trigger 41 is operated or pulled, then a wire 32 is fed out, that is, the wire 32 is played out in a loop shape from the curved portion of the leading end portion of a guide arm 33 and is wound around the mutually intersecting portions of the reinforcements 34 and, after then, the looped portion of the wire 32 is gripped in part by a twisting hook 35 and is twisted and rotated to thereby bind the reinforcements 34 together. In this binding operation, when a spool with the wire wound therearound is newly loaded in the reinforcement binding machine, the wire is played out by operating or pulling the trigger.

In another conventional reinforcement binding machine, as shown in FIG. 19, with a main switch 220 turned on previously, when binding reinforcements 224 together, if a trigger 221 is operated or pulled, then a wire 222 is fed out, that is, the wire 222 is played out in a loop shape from the leading end curved portion of a wire guide arm 223 and is wound around the mutually intersecting portions of the reinforcements 224 and, after then, the looped portion of the wire 222 is in part gripped by a twisting hook and is then twisted and rotated, thereby binding the reinforcements 224 together. Also, conventionally, it is necessary to select the material (such as iron, stainless steel or the like) of the wire according to the items to be bound together, binding objects and the like, and also the twisting torque of the twisting hook is manually changed according to the material or kind of the wire selected. If a proper twisting torque is not applied to the wire when binding the reinforcements together by the wire, then there can occur a short binding force in the wire or the wire can be twisted too much so that it is cut. To avoid this, according to the reinforcement binding machine shown in FIG. 19, a dial 225 for torque adjustment is manually operated to thereby change the twisting torque of the twisting hook.

However, when the wire is newly loaded, since the leading end of the new wire may be situated in the rear of a given position (where the cutter of a cutting device is situated), if the trigger is pulled to bind the reinforcements as it is, then the number of windings of the wire is short, which results in the short binding force, causes the wire to be twisted and cut, and so on. For this reason, after the new wire is loaded, in the first winding operation of the wire, the wire is sacrificed or thrown away without performing an actual binding processing. This is the waste of the wire.

Not only that, it is troublesome to change the twisting torque of the twisting hook by hand each time the kind of the wire varies. Also, when the kind of the wire is changed frequently, there is a possibility that the change of the twisting torque can be forgotten. Therefore, in the conventional reinforcement binding machine, there is a fear that the reinforcements cannot be bound together in a proper condition.

SUMMARY OF THE INVENTION

The present invention aims at eliminating the drawbacks found in the above-mentioned conventional reinforcement binding machine.

Accordingly, it is an object of the invention to provide, for use in a reinforcement binding machine, a newly-wire setting mechanism which prevents the sacrifice feeding of a wire to thereby be able to perform a binding operation positively from the very beginning after a new wire is loaded, without wasting the wire.

It is another object of the invention to provide a drive gears switching mechanism for use in a reinforcement binding machine which is capable of switching the output of a single electric motor to thereby be able to drive a wire feed device and a wire twisting device.

It is still another object of the invention to provide a wire kind judging mechanism which can judge the kind of the wire simply by setting a spool to automatically adjust the twisting torque of the twisting hook to the optimum torque value, thereby being able not only to avoid mistakes in the binding operation but also to improve the operation efficiency of the reinforcement binding machine.

According to a first aspect of the present invention, there is provided a reinforcement binding machine for binding reinforcement with a wire, comprising: a wire feed device for feeding out the wire; a guide arm for guiding the fed-out wire such that the wire is wound in a loop shape around the intersecting portions of the reinforcements; a wire twisting device for gripping part of the looped portion of the wire wound around the reinforcements to twist and tighten the same; a wire cutting device for cutting off the looped portion of the wire from the base portion of the wire; and a newly-wire setting mechanism including control means for positioning the leading end of the wire to a given position when newly loading the wire into the reinforcement binding machine.

According to a second aspect of the present invention, there is provided the reinforcement binding machine according to the first aspect, further comprising: detect means for detecting whether the wire is newly loaded, wherein, in accordance with the detect results of the detect means, the control means controls the wire feed device to stop when the leading end of the wire is fed up to the given position.

According to a third aspect, there is provided a drive gear switching mechanism for a reinforcement binding machine in which a wire feed device feeds out a wire for binding reinforcements together, a guide part bends the wire fed out by the wire feed device in a loop shape around the reinforcements, a wire twisting device grips part of the looped portion of the wire wound around the reinforcements to twist and tighten the same, the drive gear switching mechanism comprising: a single electric motor having an output shaft, for driving the wire feed device and twisting device; an output gear fixed to the output shaft of the electric motor; a transmission gear disposed in mesh with the output gear, the transmission gear being arranged to be movable on an arc with the axis of the output gear as a center; first and second drive gears, the first drive gear being meshable with the transmission gear when the transmission gear is positioned at one of the moving ends of the arc, and the second drive gear being meshable with the transmission gear when the transmission gear is positioned at the other moving end, wherein one of the first and second drive gears is linked with the wire feed device while the other drive gear is linked with the wire twisting device.

According to a fourth aspect of the invention, there is provided a wire kind determining mechanism in a reinforcement binding machine in which a wire feed device feeds out a wire from a spool used to bind reinforcements together, a wire guide arm guides the fed-out wire in a loop shape around the mutually intersecting portions of the reinforcements, a wire twisting device grips part of the looped portion of the wire wound around the reinforcements to twist and tighten the same, and a wire cutting device cuts off the looped portion of the wire from the base portion of the wire, the wire kind determining mechanism comprising: a marking disposed in the spool, for displaying the kind of the wire; detect means disposed in the reinforcement binding machine for detecting the marking; and control means disposed in the reinforcement binding machine, for judging the kind of the wire in accordance with the detect result by the detect means to change automatically the twisting torque of the wire twisting device according to the kind of the wire.

DETAILED DESCRIPTION OF THE PREFERRED EMBODIMENTS

Now, description will be given below in detail of the preferred embodiments of the invention with reference to the accompanying drawings.

Figure 1:
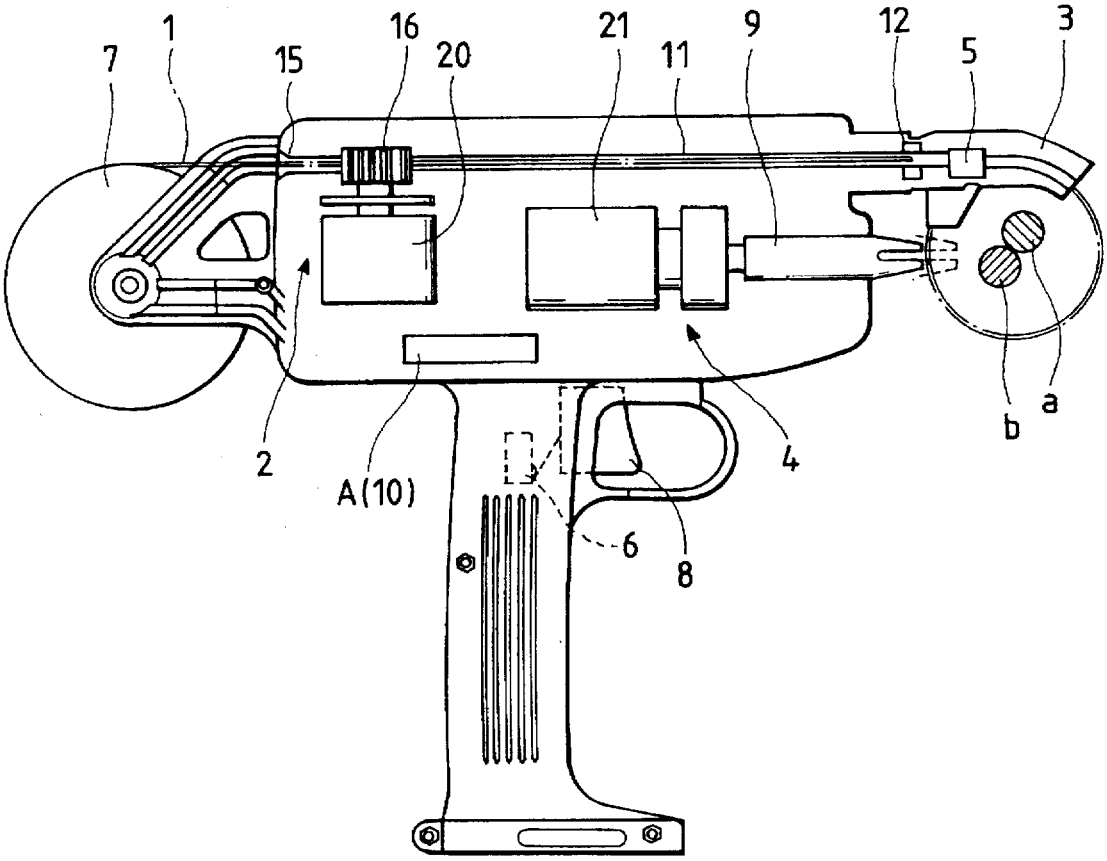
FIG. 1 is a section view of the main portions of a reinforcement binding machine employing a first embodiment of a newly-wire setting mechanism according to the invention.

At first, FIG. 1 shows a reinforcement binding machine. This reinforcement binding machine comprises: a wire feed device 2 for feeding out forwardly therefrom a wire 1 wound around a spool 7; a guide arm 3 for guiding the fed-out wire 1 in such a manner that the wire 1 can be wound in a loop shape around reinforcements; a wire twisting device 4 for gripping part of the wound wire 1 to twist and tighten the same; and a wire cutting device 5 for cutting the looped portion of the wire 1 from the base portion of the wire 1. The wire feed device 2 as well as the wire twisting device 4 and wire cutting device 5 are disposed in the main body of the reinforcement binding machine and can be operated by motors 20 and 21, respectively.

Referring now to the operation of the reinforcement binding machine structured in the above-mentioned manner, a main switch is previously turned on and, when binding reinforcements a, b together, if a trigger 8 is operated or pulled, then a micro-switch 6 is turned on to thereby rotate the motor 2 so that the wire 1 is fed out from the spool 7 by the wire feed device 2 and is then wound in a loop shape around the reinforcements a, b by the guide arm 3. After then, the motor 21 is rotated to thereby operate the wire twisting device 4 so that the looped portion of the wire is gripped in part by a hook 9 and is twistingly rotated by the wire twisting device 4 to thereby allow the wire to bind the reinforcements together, and, at the same time, the looped portion of the wire 1 is cut off from the base portion of the wire 1 by the wire cutting device 2, which completes the reinforcement binding processing.

Here, in the above-mentioned reinforcement binding machine, there is provided control means A which can recognize a wire loading mode, in which a new wire is loaded, and can stop the wire feed device 2 when the leading end of the wire 1 fed out by the wire feed device 2 is fed up to a given position.

The above-mentioned control means A can be formed of a microprocessor unit (which is hereinafter referred to as MPU) 10. This MPU 10 is arranged such that, in accordance with a control program stored in a memory (not shown), it can recognize the wire loading mode and also can control the wire feed device 2.

The above-mentioned wire loading mode can be set by performing a different operation from a normal operation, for example, the memory may be programmed in such a manner that the MPU 10 can recognize the wire loading mode when a power switch is turned on while pulling the trigger 8.

And, in a wire passage 11 disposed in front of the wire cutting device 5 (that is, at a given position), there is provided a sensor 12 which detects that the leading end of the wire 1 fed out by the wire feed device 2 reaches a given position, while the sensor 12 is arranged such that it can feed back its detect results to the MPU 10.

In the present embodiment, the sensor 12 comprises a photo-interrupter of a transmission type. That is, the sensor 12 includes a light emitting element on one side surface of the passage 11 and a light receiving element on the other surface thereof and is arranged such that the existence of the wire 1 can be detected when the wire 1 passing therethrough shuts out the light. However, this sensor may also comprise a micro-switch.

Figure 2:
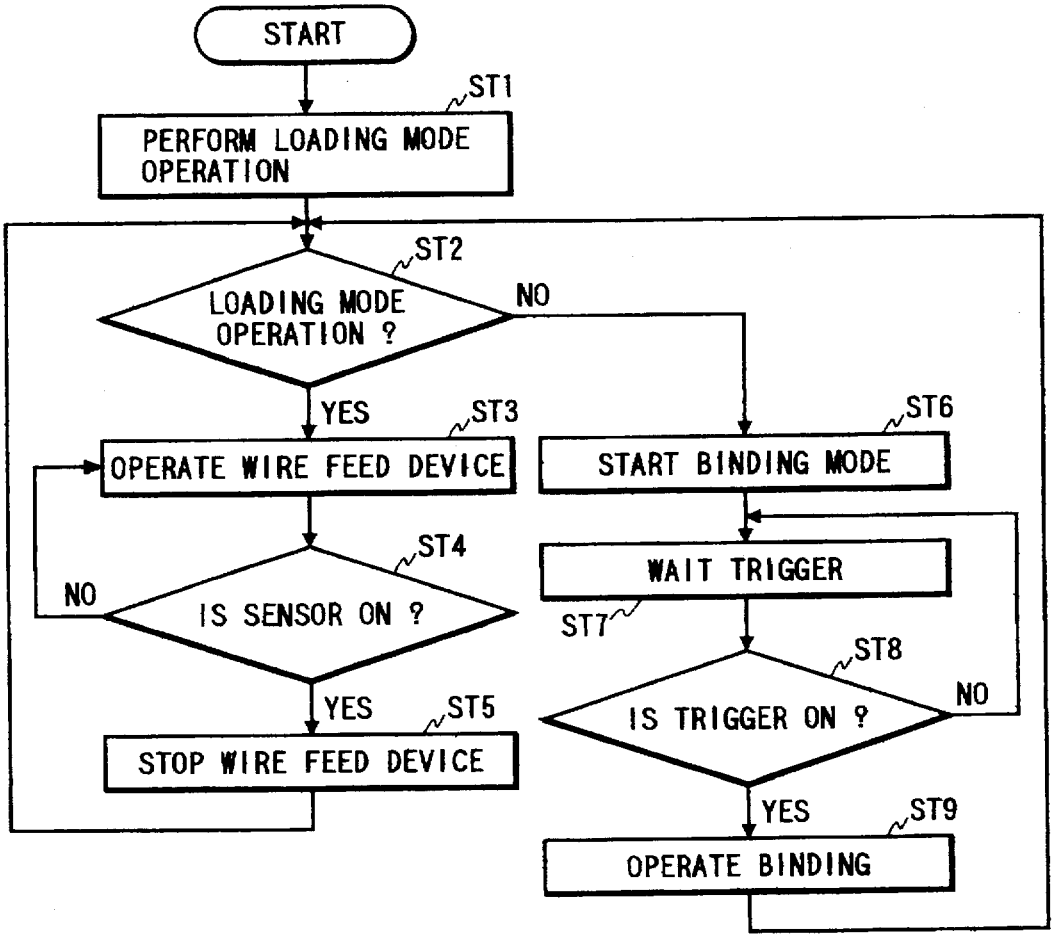
FIG. 2 is a flow chart to explain the operation of the above reinforcement binding machine.

Now, description will be given below of the operation of the reinforcement binding machine having the above-mentioned structure with reference to a flow chart shown in FIG. 2. That is, after the spool 7 with a new wire wound therearound is loaded into the reinforcement binding machine and the leading end of the wire 1 is inserted into a guide groove 15 used to guide the wire 1, if an operator performs a wire loading mode operation to turn on the power switch while pulling the trigger 7 (Step ST1), then the MPU 10 recognizes the wire loading mode because the power switch is turned on while the trigger 8 is being pulled (Step ST2). In this state, since the trigger 8 is being pulled, the wire feed device 2 is continuously operated (Step ST3) to thereby feed out the wire 1. The MPU 10 judges whether the sensor 12 detects the wire 1 or not (Step ST4). That is, if the leading end of the wire 1 reaches the sensor 12, then the sensor 12 feeds back a detect signal to the MPU 10 and, therefore, the MPU 10 judges that the leading end of the wire 1 has reached a given position, so that the processing moves to Step ST5. In Step ST5, supply of the voltage to the motor 20 is stopped to thereby cause the wire feed device 2 to stop, so that the wire loading processing can be completed.

After the wire 1 is set once, the MPU 10 judges that the reinforcement binding machine is in a binding mode (Step ST6) and thus the processing advances to Step ST7, in which the processing waits for the trigger 8 to be pulled. And, if the trigger 8 is pulled, then the processing moves to Step ST9, in which a binding processing is carried out. After then, the processing returns back to Step ST1 and then, as it is, advances through Step ST6 to Step ST7, in which the processing waits again for the trigger 8 to be pulled.

Here, the sensor 12 still continues to detect the existence of the wire 1 in the binding mode as well. In this case, however, the MPU 10 ignores the detect signal of the sensor 12 since the reinforcement binding machine is not in the wire loading mode, that is, in this case, even if the sensor 12 detects the existence of the wire 1, the MPU 10 will never stop the operation of the wire feed device 2.

As described above, by performing a different wire loading operation from a normal operation, the MPU recognizes the wire loading mode and performs the wire loading processing to stop the movement of the leading end of the wire at a given position, that is, in this case, the MPU 10 will never permit the reinforcement binding machine to carry out the binding operation. Therefore, the incomplete binding of the reinforcements can be prevented and also the waste of the wire can be eliminated. That is, a positive binding operation can be realized from the very beginning.

Figure 3:
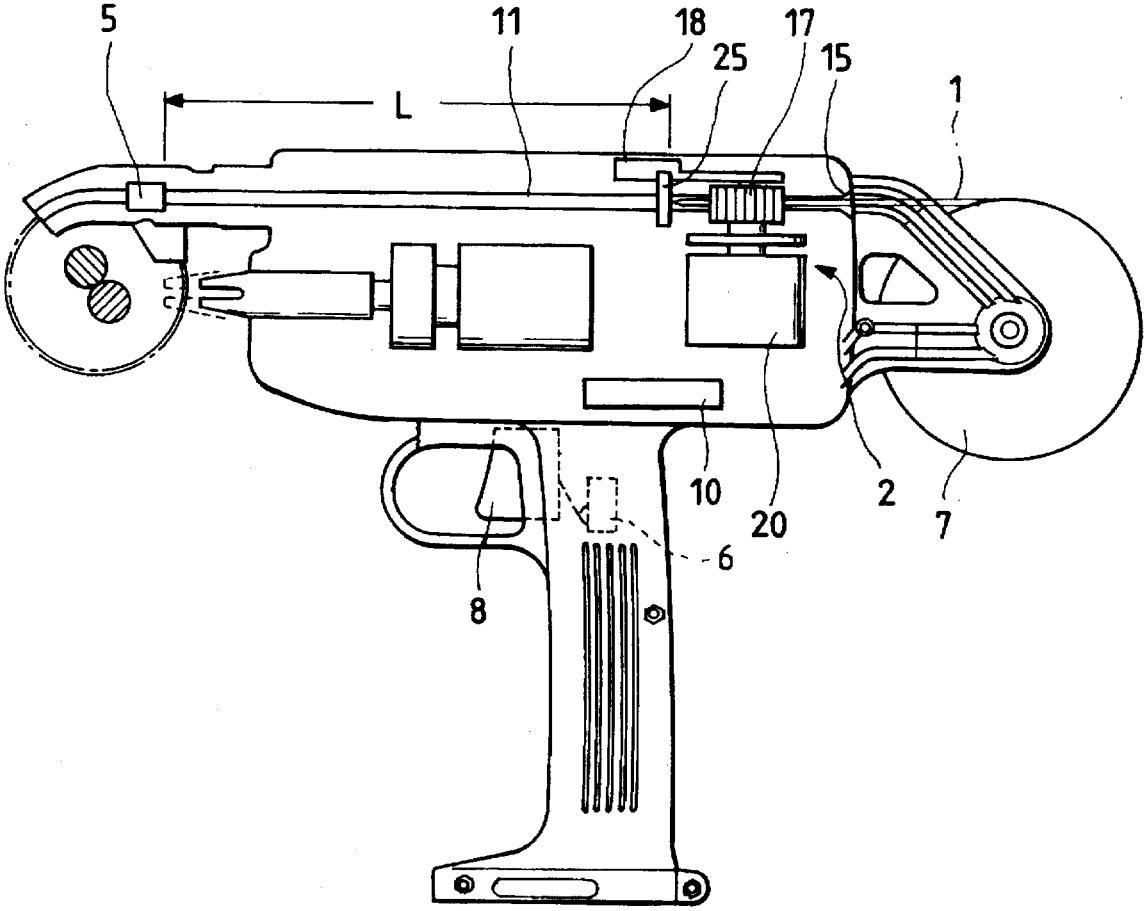
FIG. 3 is a section view of the main portions of a reinforcement binding machine employing a second embodiment of a newly-wire setting mechanism according to the invention.
Figure 4A:
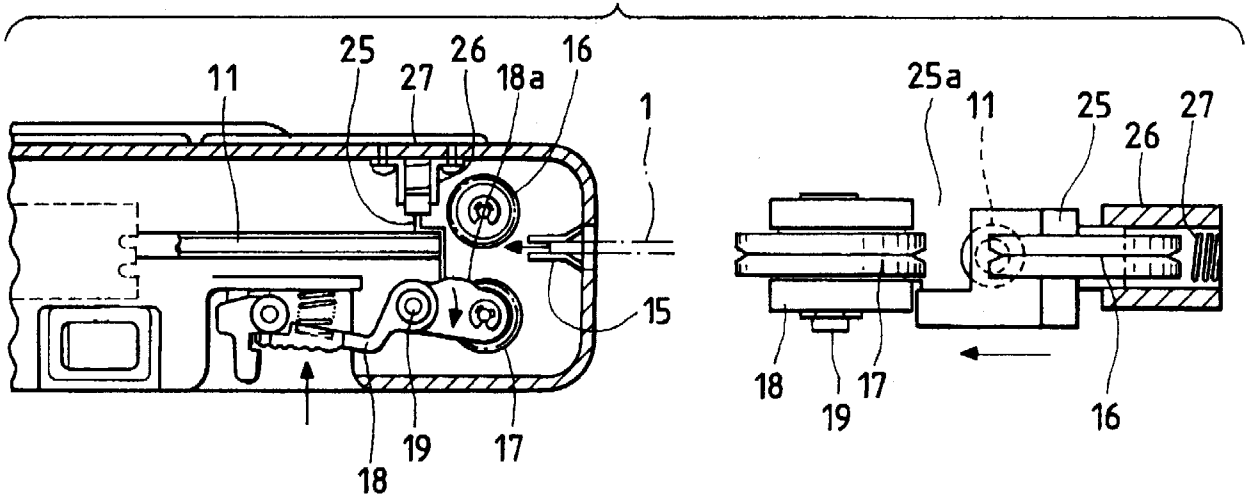
FIGS. 4(*a*) and 4(*b*) are respectively section views of the main portions of the reinforcement binding machine employing the second embodiment of a newly-wire setting mechanism according to the invention.
Figure 4B:
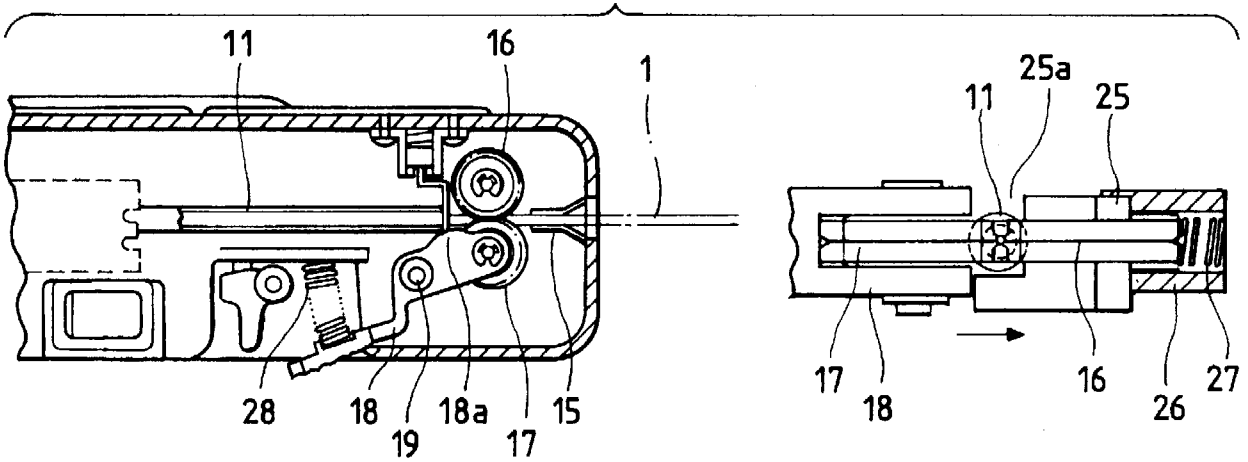

Also, a butting member may be disposed on the wire passage. In particular, the butting member 25, as shown in FIG. 3, is disposed as to shut off the wire passage 11, that is, the butting member 25 is arranged in such a manner that the wire passage 11 can be opened or closed by operating a lever 18. In more detail, as shown in FIG. 4(a), the butting member 25 includes one end which can be guided by a guide 26 and is also energized by a spring 27, while the other end of the butting member 25 is engaged with a pressure piece 18*a* provided in the lever 18 and includes a cutaway portion 25*a* which allows the wire 1 to pass therethrough. If the lever 18 is pressed to thereby rotate the lever 18 about a shaft 19, then meshing engagement between wire feed gears 16 and 17 can be removed and, at the same time, since the pressure piece 18*a* removes the pressure of the butting member 25, the butting member 25 is energized and moved by the spring 27, thereby causing the cutaway portion 25*a* to shift from the wire passage 11 so that the wire passage 11 is closed. If the lever 18 is released, then, as shown in FIG. 4(*b*), the lever 18 is energized and rotated in the reverse direction by a spring 28 to push back the butting member 25 to thereby move the cutaway portion 25*a* onto the wire passage 11 so that the wire passage 11 is opened. At the same time, the wire feed gears 16 and 17 hold the wire 1 between them and the motor 20 is rotated, so that the wire 1 can be fed out forwardly along the wire passage 11.

Here, as shown in FIG. 3, a distance L between the butting member 25 and a given position may be previously registered in the memory. That is, the MPU 10 compares the amount of feeding of the wire 1 by the wire feed device 2 with the distance L registered in the memory and, when the MPU 10 judges that the feeding amount of the wire is equal to the registered distance, then the MPU 10 may cause the wire feed device 2 to stop its operation.

Figure 5:
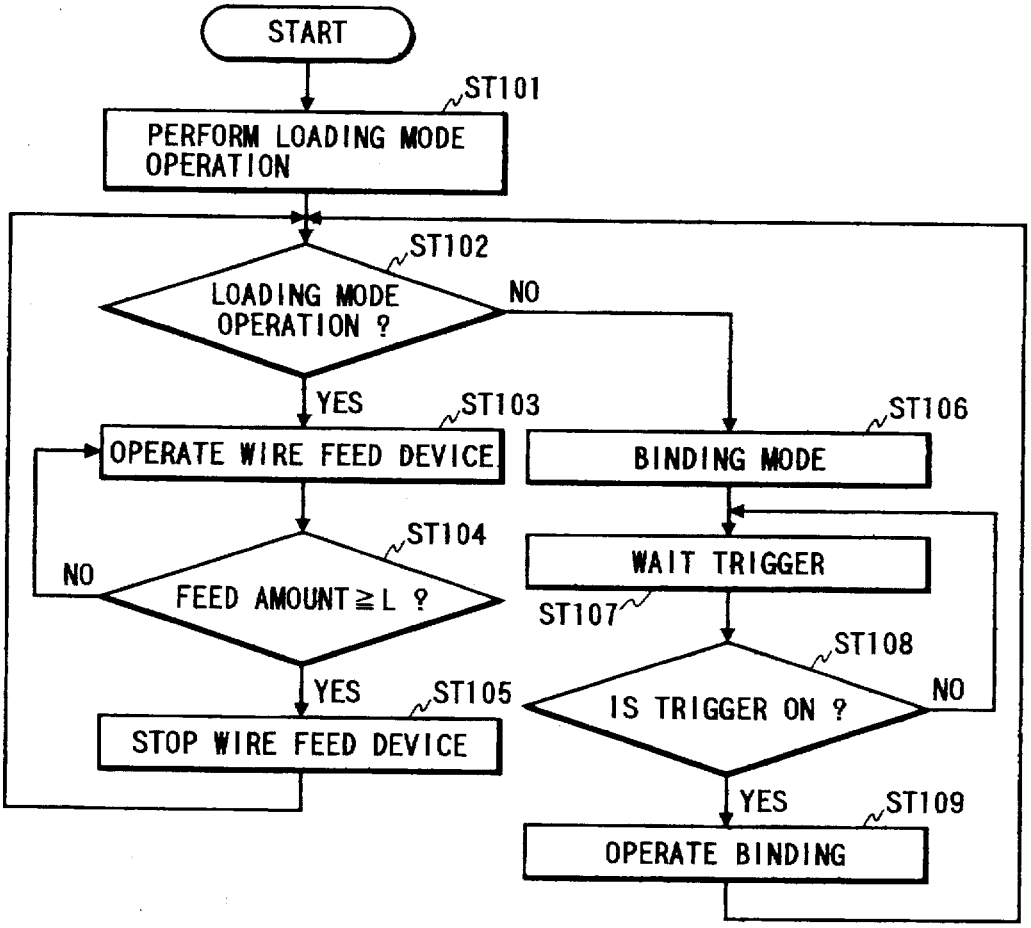
FIG. 5 is a flow chart to explain the operation of the second embodiment of a newly-wire setting mechanism according to the invention.

Next, description will be given below of the operation of the reinforcement binding machine having the above-mentioned structure with reference to a flow chart shown in FIG. 5. At first, the lever 18 is pressed to thereby remove the meshing engagement between the wire feed gears 16 and 17 and, at the same time, while the butting member 25 is set so as to shut off the wire passage 11, the wire 1 is inserted into the guide groove 15 until the leading end of the wire 1 is butted against the butting member 25. After then, if the pressure of the lever 18 is removed to thereby return the lever 18 to its original position, then the wire 1 can be bitten into between the wire feed gears 16 and 17 and, at the same time, the pressure piece 18*a* of the lever 18 moves the butting member 25 to thereby remove the butting condition. Further, after then, if the operator performs the loading mode operation to turn on the power switch while pulling the trigger 8 (Step ST101), then the MPU 10 judges that the reinforcement binding machine is in the loading mode (Step ST102) and also puts the wire feed device 2 into operation (Step ST103) to feed out the wire 1 forwardly within the wire passage 11.

If the wire feed device 2 feeds out the wire 1 by an amount equal to or greater than the distance L, then the MPU 10 judges that the leading end of the wire 1 has reached a given position (Step ST104) and thus stops the supply of the voltage to the motor 20 to thereby stop the wire feed device 2 (Step ST105). Therefore, the processing goes back to Step ST102, and thus the MPU 10 judges the reinforcement binding machine is now in the binding mode and allows the processing to advance to Step ST107, waiting for the trigger 8 to be pulled. If the trigger 8 is pulled, then the CPU 10 carries out a normal binding processing (Step ST109) and allows the processing to advance through Step ST106 to Step ST107, where the CPU 10 waits again for the trigger 8 to be pulled.

Referring here to the amount of feed of the wire, for example, the amounts of rotation of the wire feed gears 16 and 17 of the wire feed device 2 may be detected by a sensor (such as a rotary encoder) (not shown) and, in accordance with the detect results, the CPU 10 may calculate the amount of feed of the wire.

As described above, after the leading end of the wire is pressed against the butting member, by performing the loading mode operation in which the power switch is turned on while pulling the trigger, the wire can be fed out to a given position. That is, in this operation, the reinforcement binding machine is not allowed to execute the binding operation.

Also, according to the invention, a sensor may be disposed at a given position so that, when the sensor detects the leading end of the wire, the wire feed device may be stopped.

Further, in the above-mentioned reinforcement binding machine, the loading mode operation is performed by executing an operation in which the power switch is turned on while pulling the trigger. However, this is not limitative but, for example, a switch may be set at such a position as can be operated by the operator and, after the power switch is turned on, the switch may be pressed to thereby inform the MPU 10 of the loading mode.

Figure 6:
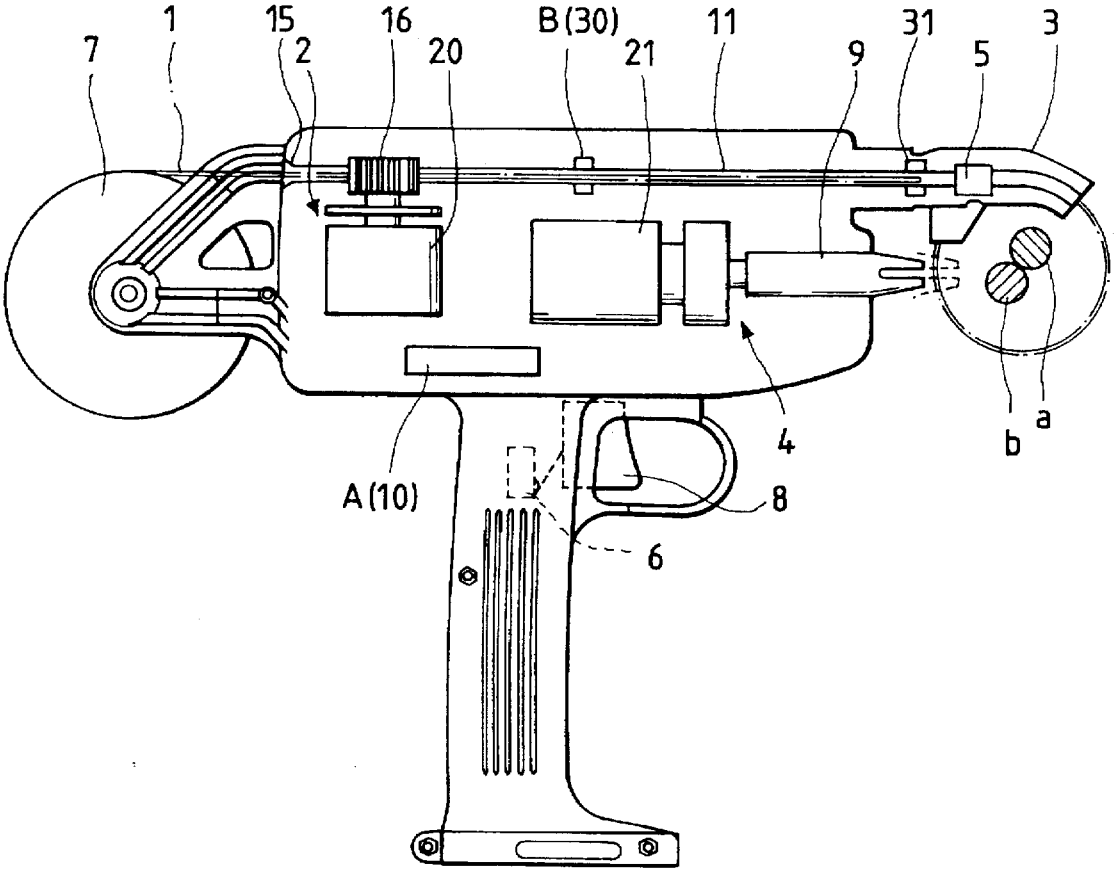
FIG. 6 is a section view of the main portions of a reinforcement binding machine employing a third embodiment of a newly-wire setting mechanism according to the invention.

Next, description will be given below of another embodiment of a reinforcement binding machine which includes detect means for detecting a loading mode. This detect means B, as shown in FIG. 6, comprises a sensor (a photointerrupter of a transmission type) 30 which is disposed in a portion of the wire passage 11. The sensor 30 is structured such that a light emitting element is provided on one side surface of the wire passage 11 while a light receiving element is disposed on the other side surface, and also that the existence of the wire 1 can be detected if the light is shut off by the wire 1 passing through the sensor 30.

When the sensor 30 does not detect the wire 1, the control unit A (MPU 10) judges that the reinforcement binding machine is in the loading mode. That is, in this case, the trigger 8 is pulled to put the wire feed device 2 into operation to feed out the wire 1. And, if the thus fed-out wire is detected by a sensor 31 disposed in front of the wire cutting device 5, then the control unit A judges that the leading end of the wire 1 has reached a given position, and thus the control unit A stops the operation of the wire feed device 2.

Figure 7:
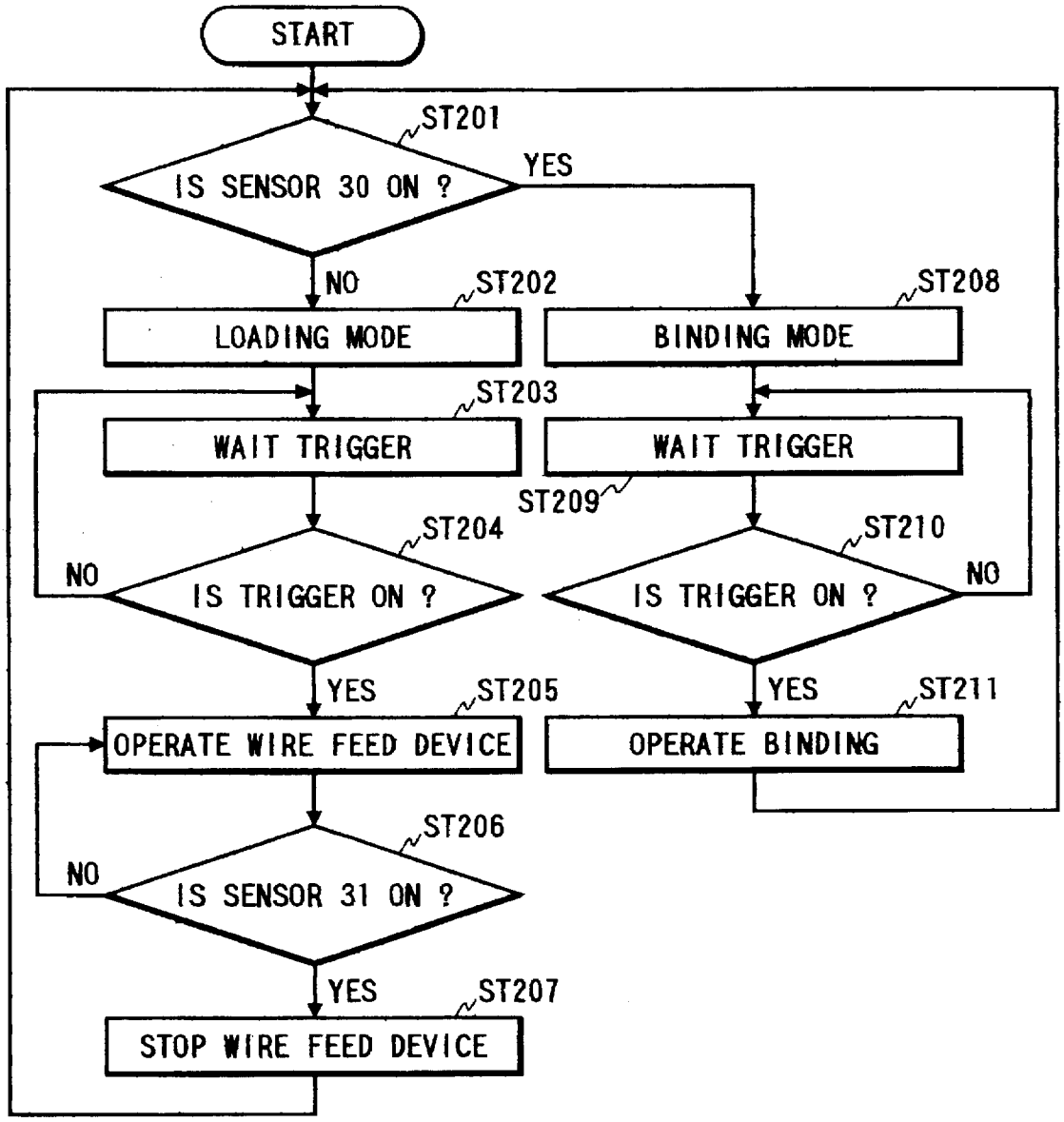
FIG. 7 is a flow chart to explain the operation of the third embodiment of a newly-wire setting mechanism according to the invention.

Now, description will be given below of the operation of the reinforcement binding machine thus structured with reference to a flow chart shown in FIG. 7.

If the power supply of the reinforcement binding machine is put to work, then in Step ST1 the control unit A checks whether the sensor 30 detects the wire 1 (whether the sensor 30 is on) or not and, if not, then the control unit A judges that the reinforcement binding machine is in the loading mode (Step ST202). In the loading mode, the control unit A waits for the trigger 8 to be pulled in Step ST203.

If the trigger 8 is pulled or turned on (Step ST204), then the control unit A allows the processing to advance to Step ST205, in which the wire feed device 2 is put into operation.

If the wire feed device 2 is operated, then the processing moves to Step ST206, in which it is checked whether the sensor 31 detects the wire 1 (whether the sensor 31 is on) or not. If the wire 1 is not detected, then the processing goes back to Step ST205, in which the wire feed device 2 is continuously operated. And, if the wire 1 is detected, then the control unit A judges that the wire 1 has reached a given position, that is, the wire feed device 2 is stopped (Step ST207) to thereby complete the loading processing, and the processing goes back to Step ST201. In this state, since the sensor 30 has detected the wire 1, the control unit A judges that the reinforcement binding machine is in the binding mode and thus allows the processing to advance to Step ST208 and wait for the trigger 8 to be pulled (Step ST209). If the trigger 8 is pulled (Step ST210), then a normal binding processing is executed (Step ST211) and, after then, the processing returns back to Step ST201 and advances to Step ST209, in which the processing waits for the trigger 8 to be pulled.

Figure 8:
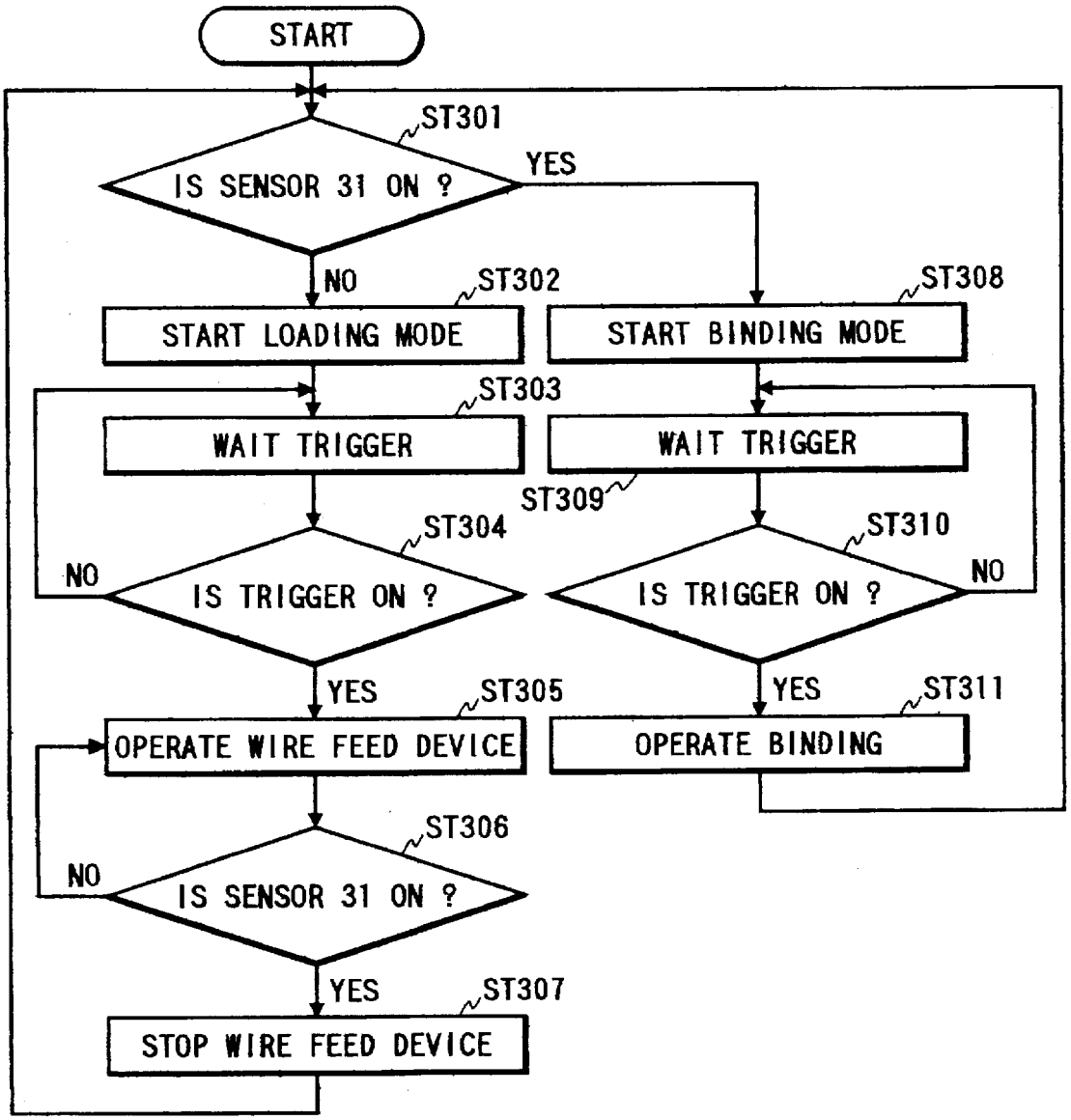
FIG. 8 is a flow chart to explain the operation of a fourth embodiment of a newly-wire setting mechanism according to the invention.
Figure 9:
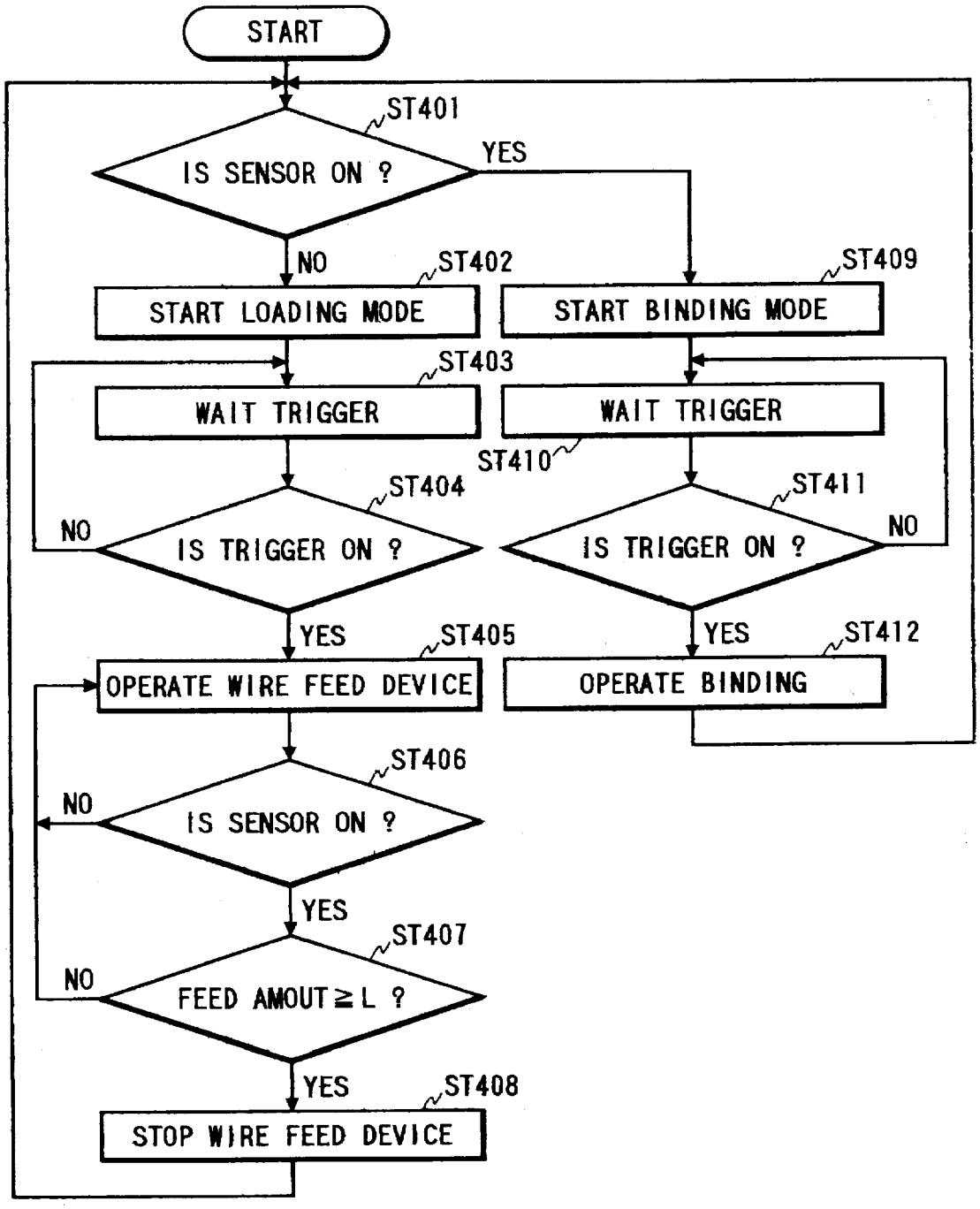
FIG. 9 is a flow chart to explain the operation of a fifth embodiment of a newly-wire setting mechanism according to the invention.

Also, according to the invention, there can be employed another structure. That is, the detect means B may be formed of the above-mentioned sensor 31, the sensor 31 may detect the loading mode by itself, and arrival of the leading end of the wire 1 at a given position may be fed back to the MPU 10. A flow chart to explain the operation of the thus structured reinforcement binding machine is as shown in FIG. 8.

In a further embodiment of the invention, the sensor 30 may be used to detect the loading mode, the distance L from the sensor 30 to a given position may be previously registered in a memory, the MPU 10 may be arranged such that it can put the wire feed device 2 into operation and compare the amount of feeding of the wire after the detection of the wire by the sensor 30 with the distance L registered in the memory. If the MPU 10 judges that the amount of feeding of the wire is equal to or more than the distance L, then it can stop the operation of the wire feed device 2. This can eliminate the need for provision of the sensor 31. A flow chart to explain the operation of the thus structured reinforcement binding machine is as shown in FIG.

As described above, when the reinforcement binding machine includes the detect means for detecting the loading mode, the MPU automatically recognizes the loading mode and thus performs a loading processing in which the operation of the wire feed device is stopped when the leading end of the wire is fed out to a given position by a trigger pulling operation to be performed for the first time after the wire is loaded. Therefore, even if a special operation for the loading mode is not executed, there is eliminated the possibility that the reinforcements can be bound together by a wire having an odd length, thereby preventing the incomplete binding of the reinforcements. Also, this eliminates the need for the sacrifice feeding of the wire to thereby be able to minimize the wasteful consumption of the wire.

Here, the above-mentioned flow charts are just typical examples to explain the loading mode and binding mode in the reinforcement binding machine. That is, the processing to be performed in the loading mode is not limited to the illustrated flow charts.

Figure 10:
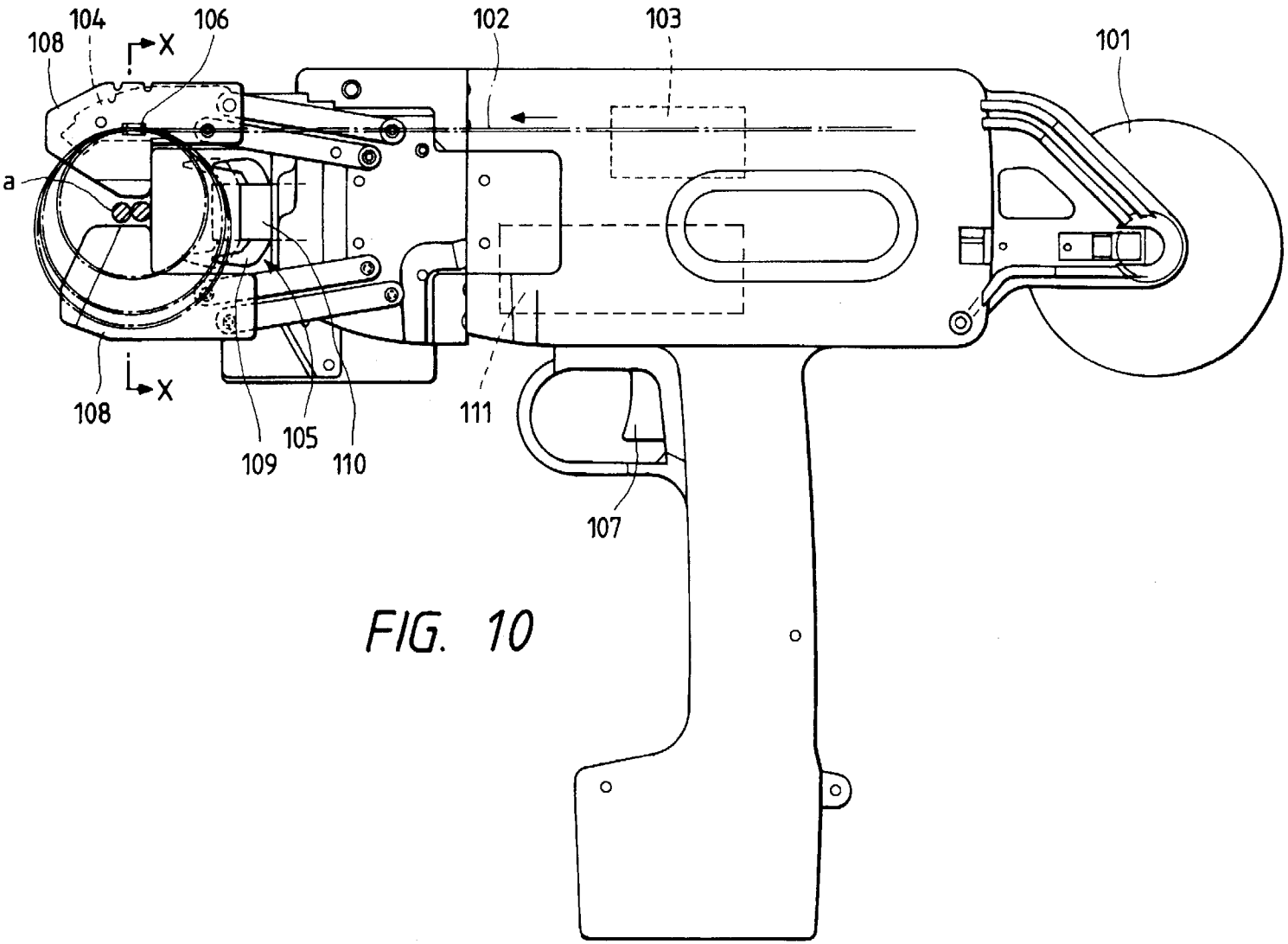
FIG. 10 is a side view of an outline of another reinforcement binding machine.
Figure 11:
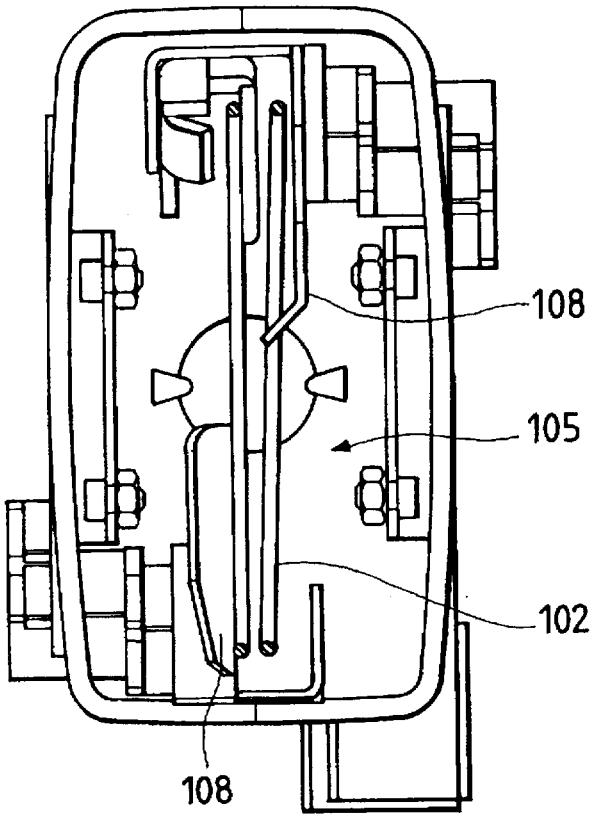
FIG. 11 is a section view taken along the line X—X in FIG. 10.

Now, in FIGS. 10 and 11, there are shown another reinforcement binding machine. The present reinforcement binding machine comprises: a wire feed device 103 for feeding forwardly therefrom a wire 102 wound around a spool 101; a guide part 104 for guiding the fed-out wire 102 in such a manner that the wire 102 can be wound in a loop shape around the intersecting portions of reinforcements a; a wire twisting device 105 for gripping as well as twisting and tightening the wire 102; and a wire cutting device 106 for cutting off the looped portion of the wire 102 from the base portion of the wire 102. In the present reinforcement binding machine having this structure, after the wire 102 fed out from the wire feed device 103 by operating or pulling a trigger lever 107 is wound in a loop shape around the reinforcements a and the looped portion of the wire is cut off from the base portion thereof, the wire twisting device 105 grips and rotates part of the looped portion of the wire 102 to twist the wire 102, thereby winding and tightening the wire 102 against the reinforcements a, so that the reinforcements a can be bound together. In the present reinforcement binding machine, the wire feed device 103 and twisting device 105 can be operated by a single electric motor 111. In FIGS. 10 and 11, guide arms 108 are used to guide the wire 102 in such a manner that, when the wire 102 is swung by the wire twisting device 105, the wire 102 can be prevented from being swung laterally. The basic structures and operations of the components of the present reinforcement binding machine are similar to the afore-mentioned.

The wire feed device 103 is structured such that, after it feeds out the wire 102 by means of the rotational movement of a roller (not shown), it cuts the wire 102 in the above-mentioned manner. Referring now to the structure of the wire twisting device 105, it includes in the leading end of a twisting shaft 110 thereof a twisting hook 109 which can be freely opened and closed. After the twisting shaft 110 is moved in the axial direction thereof by means of the forward rotation of the drive gear according to the applied technique of a ball screw, the hook 109 is closed to thereby grip the wire 102, and the twisting shaft 110 is rotated forwardly to thereby twist the wire 102, that is, the wire 102 is twisted and tightened. After then, the hook 109 is opened by rotating the drive gear in the reversed direction to thereby remove the wire 102 and, next, the twisting shaft 110 is moved or returned to its original position. However, it should be noted here that the structure of the wire twisting device is not limited to the above-mentioned structure. For example, a split groove may be formed in the leading end portion of the twisting shaft so that the wire fed in a loop shape can pass therethrough and, after the wire is fed, the twisting shaft may be rotated to thereby twist the wire.

Figure 12:
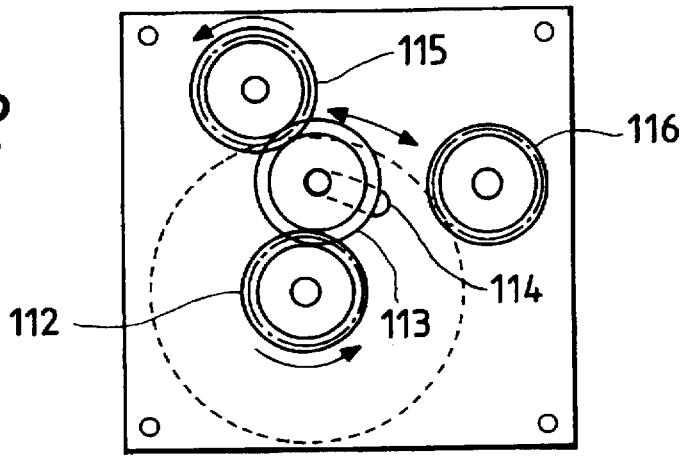
FIG. 12 is a front view of a drive gears switching mechanism employed in the above reinforcement binding machine.
Figure 13:
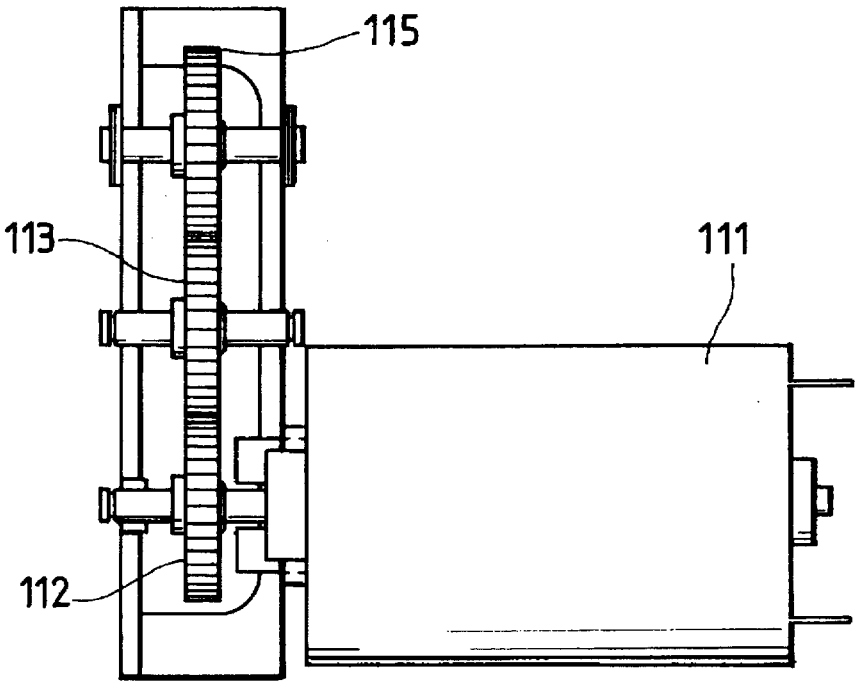
FIG. 13 is a side view of the above drive gears switching mechanism.

Next, the above-mentioned respective devices are structured such that they can be operated by a common electric motor. That is, as shown in FIGS. 12 and 13, an output gear 112 is fixed to the output shaft of the electric motor 111, while a transmission gear 113 is in mesh with the output gear 112. The transmission gear 113 is arranged such that it can move along a moving groove 114 formed on an arc with the axis of the output gear 112 as a center thereof. Also, near the two ends of the moving groove 114, there are disposed a first drive gear 115 and a second drive gear 116. The first drive gear 115 is linked with the wire feed device 103, while the second drive gear 116 is linked with the wire twisting device 105. And, the first drive gear 115 is arranged so as to be meshable with the transmission gear 113 when the transmission gear 113 is situated at one of the two moving ends of the moving groove 114, while the second drive gear 116 is arranged so as to be meshable with the transmission gear 113 when the transmission gear 113 is situated at the other moving end of the moving groove 114.

Referring here to the cutting operation of the wire 102, after the wire 102 is fed out by a given amount by the wire feed device 103, the wire feed device 103 is operated by the same drive gear, that is, the first drive gear 115, so that the wire 102 can be cut by the wire feed device 103.

Figure 14:
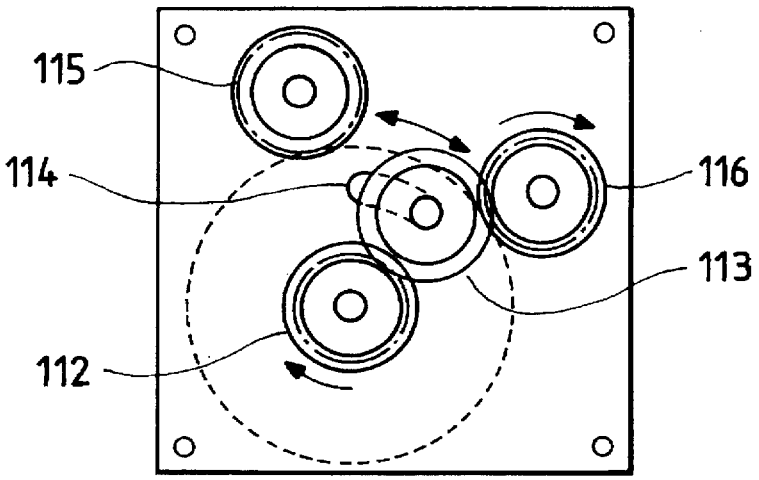
FIG. 14 is an explanatory view of the operation of the above drive gears switching mechanism.

Therefore, according to the above-mentioned structure, if the electric motor 111 is rotated counterclockwise in FIG. 11, then the transmission gear 113 in mesh with the output gear 112 is rotated and is moved to the left side of the moving groove 114 due to the rotational force of the output gear 112 so that the transmission gear 113 is put into mesh with the first drive gear 115 at the left moving end of the moving groove 114. In response to this, the wire feed device 103 is operated to feed out the wire 102 and, after the wire 102 is fed by a given amount and is wound around the reinforcements a, the wire 102 is cut by the wire feed device 103. Next, if the electric motor 111 is stopped, then the operation of the wire feed device 103 can be stopped. After then, if the electric motor 111 is rotated in the reversed direction, then, as shown in FIG. 14, the transmission gear 113 is moved to the right side of the moving groove 114 and is meshed with the second drive gear 116 at the right moving end of the moving groove 14, which causes the wire twisting device 105 to be put into operation to thereby twist the wire 102, so that the winding and tightening of the reinforcements, that is, the binding of the reinforcements can be completed.

On the other hand, even when the first and second drive gears 115 and 116 are respectively linked with the wire twisting and feed devices 105 and 103, the operations thereof are similar to the above-mentioned case.

Now, description will be given below of a wire kind judging mechanism according to the invention with reference to the accompanying drawings.

Figure 15:
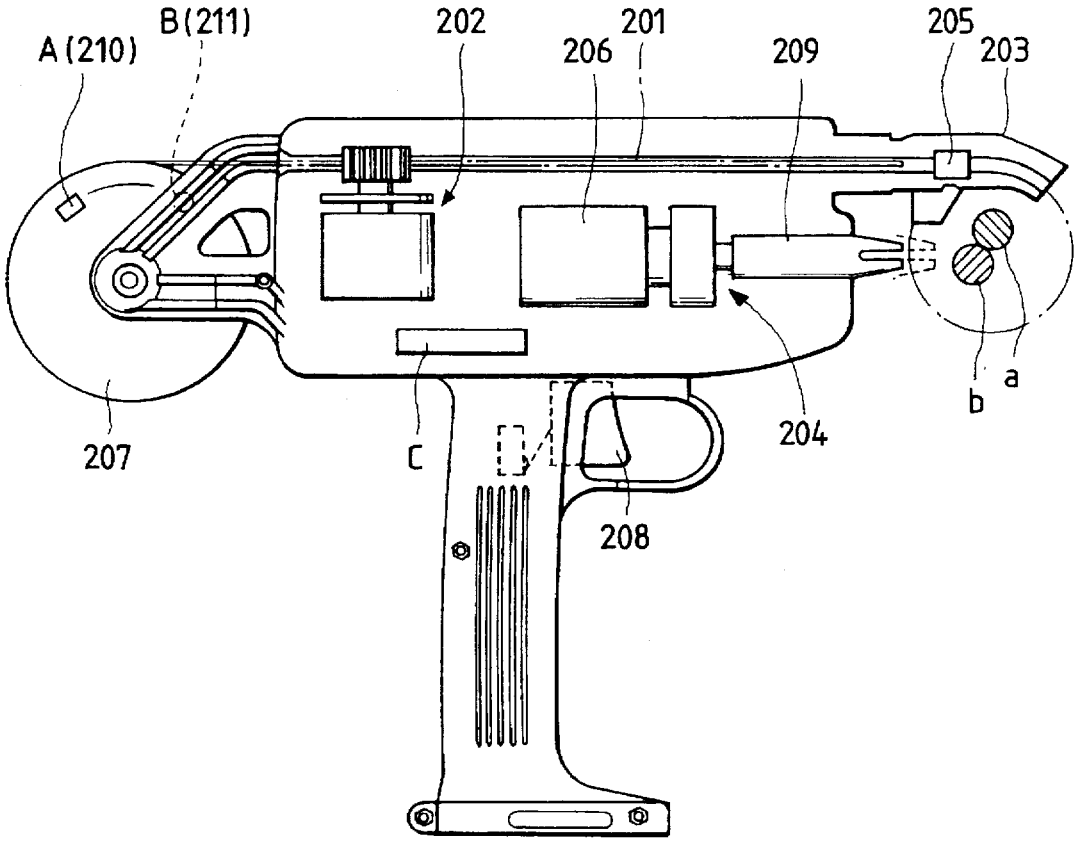
FIG. 15 is a side view of a reinforcement binding machine to which a wire kind judging mechanism according to the invention is applied.

FIG. 15 shows the main portions of a reinforcement binding machine which comprises: a wire feed device 202 for feeding out forwardly therefrom a wire 1 wound around a spool 207; a wire guide arm 203 for guiding the fed-out wire 201 in such a manner that the wire 201 can be wound in a loop shape; a twisting device 204 for gripping part of the wire 201 wound to twist and tighten the same; and a wire cutting device 205 for cutting the looped portion of the wire 201 from the base portion thereof. The wire feed device 202, twisting device 204, and cutting device 205 can be respectively operated by a motor which is disposed in a main body of the reinforcement binding machine.

Referring now to the operation of the above-structured reinforcement binding machine, a main switch is previously turned on. When binding the reinforcements a, b together, if a trigger 208 is operated or pulled, then the wire 201 is fed out from a spool 207 by the wire feed device 202 and is then wound in a loop manner by the guide arm 203. After then, the looped portion of the wire 201 is in part gripped and twistingly rotated by a twisting hook 209 to thereby bind the reinforcements a, b together by the wire 201 and, at the same time, the looped portion of the wire 201 is cut off from the base portion thereof by the wire cutting device 205.

According to the present embodiment, in the spool 207, there is provided a marking A which displays the kind (such as iron, stainless steel or the like) and thickness of the wire 201 wound around the spool 207; while, in the reinforcement binding machine, there are disposed detect means B for detecting the marking A, and control means C for adjusting automatically the twisting torque of the twisting device in accordance with the detected result by the detect means B.

The marking A comprises a reflecting seal 210 which is bonded to one of the two side surfaces of the spool 207, while the reflecting seal 210 may be formed of aluminum foil tape having an adhesive layer on the back surface thereof. The distance between the reflecting seal 210 and the support shaft 207*a* of the spool 207 may be previously set according to the kind of the wire 201 and it may be bonded at one or more positions on a concentric circle. Here, since the surroundings in which the reinforcement binding machine is used are not always good (for example, the binding machine can be used in the rain), preferably, two or more reflecting seals may be respectively provided at two or more positions on the concentric circle in preparation against the peel-off of the reflecting seal 210.

The detect means B is formed of a photo-sensor (a photo interrupter of a reflection type) 211, while the detect means B is disposed on one inner side surface (that corresponds to the side surface on which the reflecting seal 210 is bonded) of a support portion 212 for supporting the spool 207. The photo-sensor 211 is positioned at a given distance about a bearing 213 for supporting the spool 207. Of course, the position of the photo-sensor 211 corresponds to the reflecting seal 210 that is bonded to the spool 207.

Figure 17:
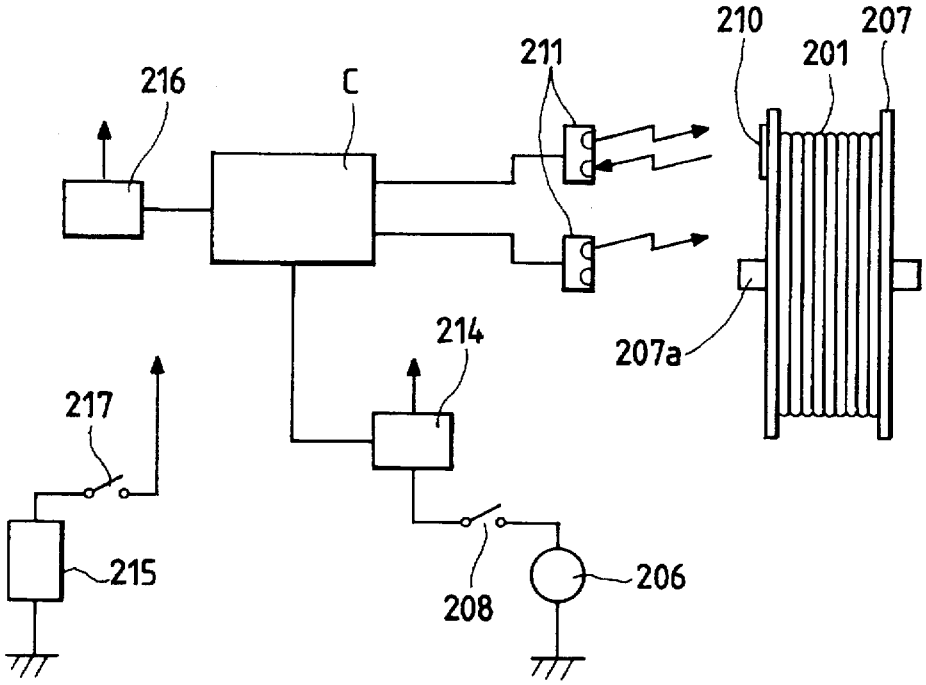
FIG. 17 is a block diagram of the above wire kind judging mechanism.
Figure 18:
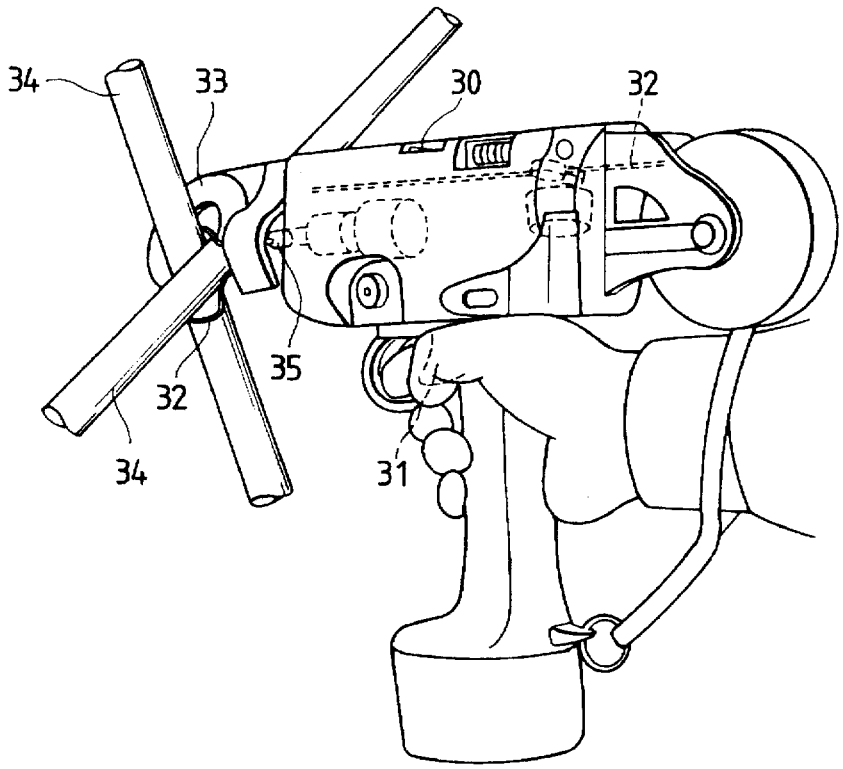
FIG. 18 is a perspective view to show how a conventional reinforcement binding machine is used.
Figure 19:
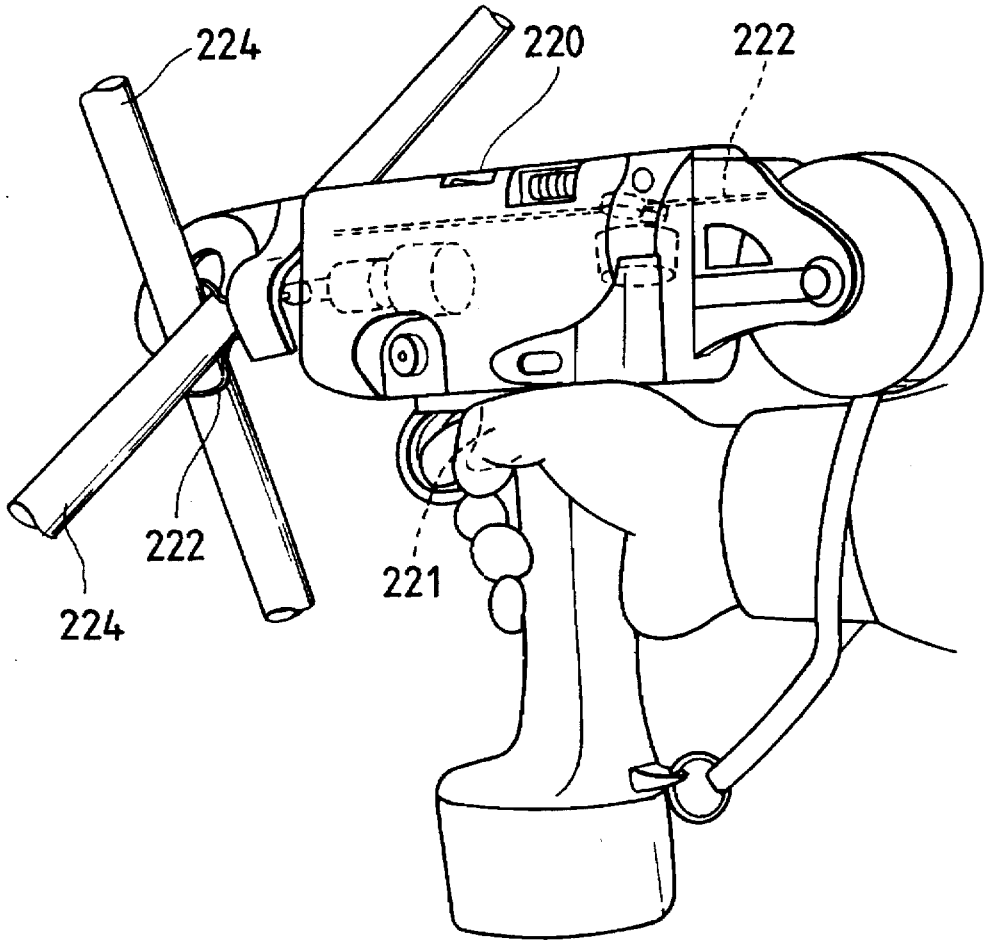
FIG. 19 is a perspective view of another conventional reinforcement binding machine, illustrating how it is used.

The control means C comprises a microprocessor unit (MPU) and is arranged so as to judge the presence or absence of a detect signal of the photo-sensor 211 in accordance with a program stored in an internal memory. That is, depending on which photo-sensor 211 has detected the reflecting seal 210, the control means C judges the kind of the wire 201 and, in accordance with the kind of the wire 201, controls a current control circuit 214 to thereby automatically change a current flowing into a motor 206 which drives the twisting device 204, so that the twisting device 204 can be operated with the optimum twisting torque for the wire 201 (see FIG. 17). In FIG. 17, a DC-DC converter 216 is used to convert a voltage supplied from a battery pack 215 into a voltage of an IC level that is used to operate the detect means B and control means C.

Figure 16:
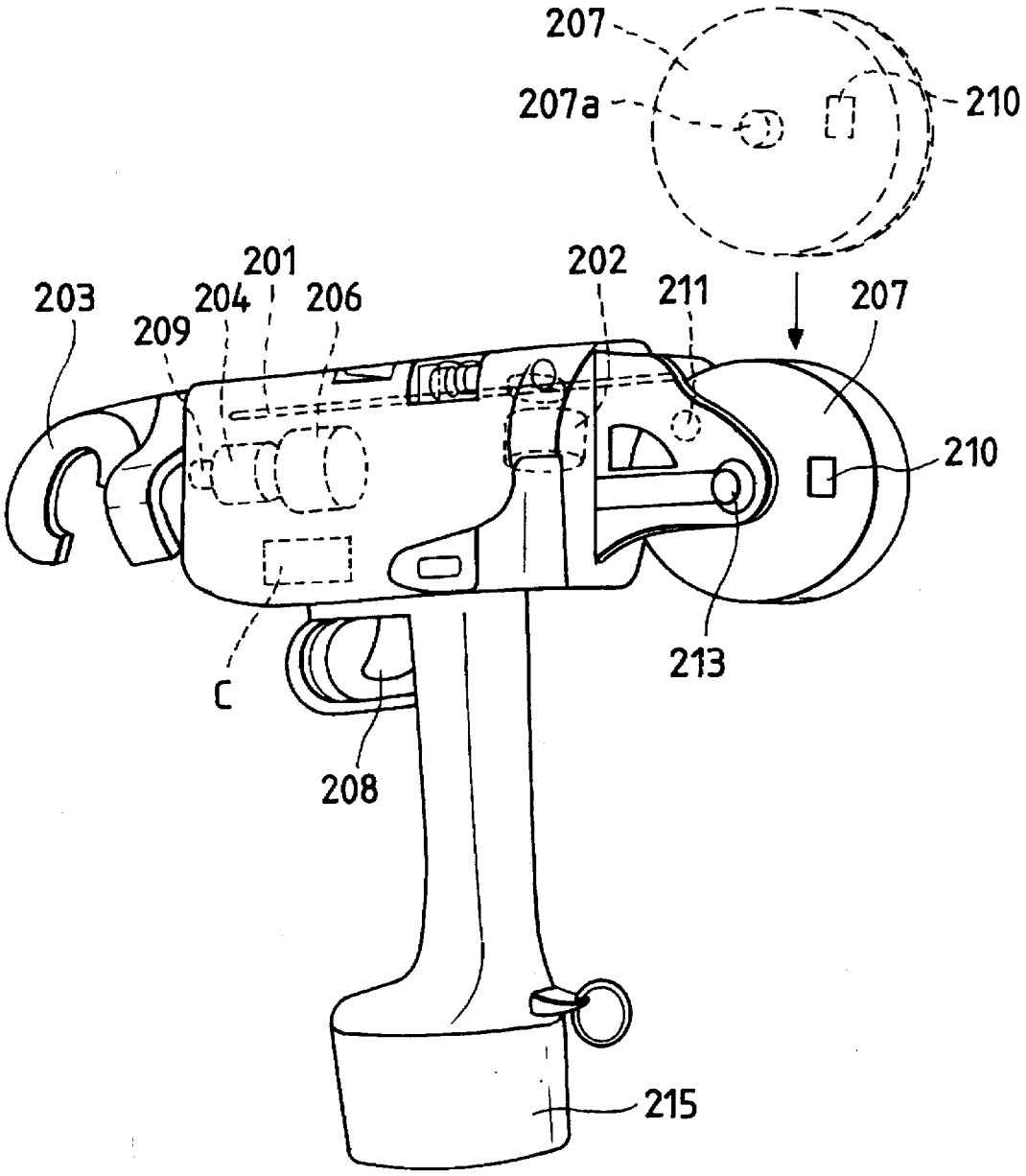
FIG. 16 is a perspective view of the above reinforcement binding machine.

According to the reinforcement binding machine having the above-mentioned structure, as shown in FIG. 16, after the fully charged battery pack 215 is installed and the spool 207 with the wire 201 wound therearound is loaded into the reinforcement binding machine, the leading end of the wire 201 is inserted into a guide groove (not shown) for the wire 201, and a main switch 17 is turned on and the trigger 208 is pulled to thereby operate the wire feed device 202, so that the leading end of the wire 201 can be idly fed up to a given position.

At the then time, since the spool 207 is rotated and the reflecting seal 210 passes through the front surface of the photo-sensor 211, the reflecting seal 210 reflects the light that is emitted by the light emitting element of the photo-sensor 211, while the light receiving element of the photo-sensor 211 receives the thus reflected light and transmits a detect signal to the control means C. Responsive to this, the control means C judges the kind of the spool 207 (that is, the kind of the wire 201) according to the detect signal of the photo-sensor 211 and sets the current flowing into the motor 206 at the optimum current value for the wire 201 to thereby determine the twisting torque automatically.

Here, alternatively, it is also possible to provide a micro-switch (not shown) which is used to recognize that the spool 207 is set in the bearing 213 of the support portion 212. In this case, the control means C judges the detect signal of the photo-sensor 211 under the condition that the micro-switch is on; and, after the photo-sensor 211 is detected once, the control means C ignores the detect signals of the photo-sensors 211 that are detected afterwards and can rotate the motor 206 continuously with the same torque until the micro-switch is turned off.

Also, according to a further aspect of the invention, a plurality of reflecting seals 210 may be bonded to the side surface of the spool 207 in the diametrical direction of the spool 207. That is, by means of combinations of these reflecting seals 210, a larger number of kinds of the wires can be judged. However, it should noted here that, even when no reflecting seal 210 is bonded, of course, one kind of the wire can be displayed.

Further, the marking A is not limited to the reflecting seal 210. For example, the marking A may be formed of a bar code label and the detect means B may be formed of a bar code scanner accordingly; a magnet may be embedded into the side surface of the spool 207 and the magnet may be detected by a magnetic sensor such as a lead switch, a Hall device or the like; or, there may be provided a recessed portion or a projecting portion in the side surface of the spool 207 and such recessed or projecting portion may be detected by a micro-switch of a roller-lever type to thereby judge the kind of the spool (that is, the kind of the wire).

In addition, the marking 204 may be provided in part of the peripheral surface of the spool 207.

According to the invention, when the trigger is pulled in the loading mode, the loading processing is executed but the binding processing is not carried out. This eliminates the possibility that the reinforcements can be bound together by a wire having an insufficient or odd length, thereby being able to prevent the incomplete binding of the reinforcements. Also, the present invention can dispense with the sacrifice feeding of the wire, which in turn make it possible to minimize the wasteful consumption of the wire.

Also, according to the invention, only by loading the wire into the reinforcement binding machine, the loading mode can be recognized automatically. This avoids the need to perform a special operation for the loading mode each time a new wire is loaded, that is, the loading processing can be carried out automatically by a normal operation, thereby eliminating the possibility that the reinforcements can be bound together by a wire having an odd length. Due to this, it is possible not only to prevent the sacrifice feeding of the wire but also to prevent the incomplete binding of the reinforcements, so that the wasteful consumption of the wire can be minimized.

According to the invention, by rotating the electric motor forwardly and reversely, the output of the electric motor can be switched over to between the first and second drive gears so that the feeding and twisting operations of the wire can be carried out accordingly. Due to this, all of operations necessary to bind the reinforcements together can be performed by use of a single electric motor.

This can save one of the two electric motors and a space necessary for provision of the electric motor to be saved. Therefore, the reinforcement binding machine can be reduced in both size and weight.

According to the invention, simply by loading the spool with the wire wound therearound into the reinforcement binding machine and by pulling the trigger to feed the wire idly, the kind of the wire can be judged and the twisting torque can be adjusted automatically. This eliminates the need to change the twisting torque by use of a dial or a switch each time the kind of the wire varies. Also, even when the kind of the wire is changed frequently, it is possible to avoid the wrong setting of the twisting torque as well as troubles caused by forgetting the change of the twisting torque. That is, according to the invention, the reinforcements can be bound together safely and efficiently.

What is claimed is:

1. A reinforcement binding machine for binding reinforcement with a wire, comprising:

a wire feed device for feeding out the wire;

a guide arm for guiding the fed-out wire such that the wire is wound in a loop shape around the intersecting portions of the reinforcements;

a wire twisting device for gripping part of the looped portion of the wire wound around the reinforcements to twist and tighten the same;

a wire cutting device for cutting off the looped portion of the wire from the base portion of the wire; and a newly-wire setting mechanism including control means for positioning the leading end of the wire to a given position when newly loading the wire into the reinforcement binding machine.

2. The reinforcement binding machine according to claim 1, further comprising:

detect means for detecting whether the wire is newly loaded, wherein, in accordance with the detect results of the detect means, the control means controls the wire feed device to stop when the leading end of the wire is fed up to the given position.

3. The reinforcement binding machine according to claim 2, further comprising a drive gear switching mechanism which comprises:

a single electric motor having an output shaft, for driving the wire feed device and the wire twisting device;

an output gear fixed to the output shaft of the electric motor;

a transmission gear disposed in mesh with the output gear, the transmission gear being arranged to be movable on an arc with the axis of the output gear as a center;

first and second drive gears, the first drive gear being meshable with the transmission gear when the transmission gear is positioned at one of the moving ends of the arc, and the second drive gear being meshable with the transmission gear when the transmission gear is positioned at the other moving end, wherein one of the first and second drive gears is linked with the wire feed device while the other drive gear is linked with the wire twisting device.

4. The reinforcement binding machine according to claim 2, further comprising a wire kind determining mechanism which comprises:

a marking disposed in the spool, for displaying the kind of the wire;

marking-detect means disposed in the reinforcement binding machine for detecting the marking; and control means disposed in the reinforcement binding machine, for judging the kind of the wire in accordance with the detect result by the marking-detect means to change automatically the twisting torque of the wire twisting device according to the kind of the wire.

5. The reinforcement binding machine according to claim 1, further comprising a drive gear switching mechanism which comprises:

a single electric motor having an output shaft, for driving the wire feed device and the wire twisting device;

an output gear fixed to the output shaft of the electric motor;

a transmission gear disposed in mesh with the output gear, the transmission gear being arranged to be movable on an arc with the axis of the output gear as a center;

first and second drive gears, the first drive gear being meshable with the transmission gear when the transmission gear is positioned at one of the moving ends of the arc, and the second drive gear being meshable with the transmission gear when the transmission gear is positioned at the other moving end, wherein one of the first and second drive gears is linked with the wire feed device while the other drive gear is linked with the wire twisting device.

6. The reinforcement binding machine according to claim 1, further comprising a wire kind determining mechanism which comprises:

a marking disposed in the spool, for displaying the kind of the wire;

marking-detect means disposed in the reinforcement binding machine for detecting the marking; and control means disposed in the reinforcement binding machine, for judging the kind of the wire in accordance with the detect result by the marking-detect means to change automatically the twisting torque of the wire twisting device according to the kind of the wire.

7. A drive gear switching mechanism for a reinforcement binding machine in which a wire feed device feeds out a wire for binding reinforcements together, a guide part bends the wire fed out by the wire feed device in a loop shape around the reinforcements, a wire twisting device grips part of the looped portion of the wire wound around the reinforcements to twist and tighten the same, the drive gear switching mechanism comprising:

a single electric motor having an output shaft, for driving the wire feed device and twisting device;

an output gear fixed to the output shaft of the electric motor;

a transmission gear disposed in mesh with the output gear, the transmission gear being arranged to be movable on an arc with the axis of the output gear as a center;

first and second drive gears, the first drive gear being meshable with the transmission gear when the transmission gear is positioned at one of the moving ends of the arc, and the second drive gear being meshable with the transmission gear when the transmission gear is positioned at the other moving end, wherein one of the first and second drive gears is linked with the wire feed device while the other drive gear is linked with the wire twisting device.

8. A wire kind determining mechanism in a reinforcement binding machine in which a wire feed device feeds out a wire from a spool used to bind reinforcements together, a wire guide arm guides the fed-out wire in a loop shape around the mutually intersecting portions of the reinforcements, a wire twisting device grips part of the looped portion of the wire wound around the reinforcements to twist and tighten the same, and a wire cutting device cuts off the looped portion of the wire from the base portion of the wire, the wire kind determining mechanism comprising:

a marking disposed in the spool, for displaying the kind of the wire;

detect means disposed in the reinforcement binding machine for detecting the marking; and control means disposed in the reinforcement binding machine, for judging the kind of the wire in accordance with the detect result by the detect means to change automatically the twisting torque of the wire twisting device according to the kind of the wire.

* * * * *